US008387345B2

(12) United States Patent
Polloni et al.

(10) Patent No.: US 8,387,345 B2
(45) Date of Patent: Mar. 5, 2013

(54) CIGARETTE PACKING MACHINE AND METHOD

(75) Inventors: Roberto Polloni, Modigliana (IT); Gilberto Spirito, Bologna (IT); Claudio Foghetti, Montelabbate (IT); Vladi Negrini, Bologna (IT); Giacomo Roffia, Minerbio (IT); Andrea Biondi, Bologna (IT); Marco Fiorentini, Marzabotto (IT)

(73) Assignee: G. D Societa' per Azioni, Bologna (IT)

( * ) Notice: Subject to any disclaimer, the term of this patent is extended or adjusted under 35 U.S.C. 154(b) by 414 days.

(21) Appl. No.: 12/776,472

(22) Filed: May 10, 2010

(65) Prior Publication Data

US 2010/0287890 A1 Nov. 18, 2010

(30) Foreign Application Priority Data

May 15, 2009 (IT) ..... BO2009A0317

(51) Int. Cl.

| | |
|---|---|
| ***B65B 19/22*** | (2006.01) |
| ***B65B 19/28*** | (2006.01) |
| ***B65B 61/02*** | (2006.01) |
| ***B65B 61/06*** | (2006.01) |

(52) U.S. Cl. ..... 53/411; 53/466; 53/51; 53/64; 53/131.5; 53/234; 53/389.3

(58) Field of Classification Search ..... 53/411, 53/466, 51, 64, 131.2, 131.4, 131.5, 141, 53/234, 389.3; *B65B 61/02, 19/28*

See application file for complete search history.

(56) References Cited

U.S. PATENT DOCUMENTS

| | | | | |
|---|---|---|---|---|
| 3,237,973 | A * | 3/1966 | Rumberger | 53/51 |
| 4,680,205 | A * | 7/1987 | Lerner et al. | 53/51 |
| 5,783,266 | A | 7/1998 | Gehrke | |
| 6,027,820 | A * | 2/2000 | O'Hagan et al. | 428/543 |
| 6,234,943 | B1 * | 5/2001 | Copin | 53/51 |
| 6,857,358 | B2 * | 2/2005 | Dittrich et al. | 53/51 |
| 2001/0010332 | A1 | 8/2001 | Bismarck et al. | |

FOREIGN PATENT DOCUMENTS

| | | | |
|---|---|---|---|
| EP | 1 209 083 | A | 5/2002 |
| EP | 1 770 015 | A | 4/2007 |
| GB | 2131767 | A * | 6/1984 |
| WO | WO 9829312 | A1 * | 7/1998 |
| WO | 01/94098 | A | 12/2001 |

* cited by examiner

*Primary Examiner* — Stephen F Gerrity
(74) *Attorney, Agent, or Firm* — Ladas & Parry LLP

(57) ABSTRACT

A method and machine for folding sheets of packing material about respective groups of cigarettes to form respective packages, and wherein a web of packing material is first fed through a control station for detecting the position of a reference mark made on the web at a work station upstream from the control station, and is then fed through a cutting station where the web is cut into sheets of packing material, each of which is fed to a packing station where each sheet of packing material is folded about the respective group of cigarettes.

19 Claims, 7 Drawing Sheets

CIGARETTE PACKING MACHINE AND METHOD

TECHNICAL FIELD

The present invention relates to a machine and method for packing cigarettes, in the example described, in rigid, hinged-lid packets.

BACKGROUND ART

Rigid, hinged-lid packets of cigarettes are currently the most widely marketed, by being easy and practical to use, and by providing good protection for the cigarettes inside.

A rigid, hinged-lid packet of cigarettes normally comprises a soft inner package housed in a rigid outer package. The inner package comprises a sheet of packing material wrapped about a group of cigarettes; and the outer package comprises a cup-shaped container with an open top end, and a cup-shaped lid hinged to the container along a hinge to rotate, with respect to the container, between an open position and a closed position opening and closing the open end respectively. A collar is normally folded and connected to the inside of the container to project partly outwards of the top end of the outer package and engage a corresponding portion of the inner surface of the lid when this is in the closed position.

Packing machines are known to employ a device for producing sheets of packing material from a web having reference marks, which are normally equally spaced along one edge of the web, and serve to synchronize one or more work stations with the throughput speed of the web.

Unfortunately, the reference marks and other similar distinguishing marks on the sheet of packing material are normally made in ink, which, if not applied properly, may contaminate the group of cigarettes about which the sheet is wrapped.

DISCLOSURE OF THE INVENTION

It is an object of the present invention to provide a cigarette packing machine and method designed to eliminate the above drawback, and which, at the same time, are cheap and easy to implement.

According to the present invention, there are provided a packing machine and method for producing a packet of cigarettes, as claimed in the attached Claims.

BRIEF DESCRIPTION OF THE DRAWINGS

A number of non-limiting embodiments of the present invention will be described by way of example with reference to the accompanying drawings, in which.

PREFERRED EMBODIMENT OF THE INVENTION

Figure 1:
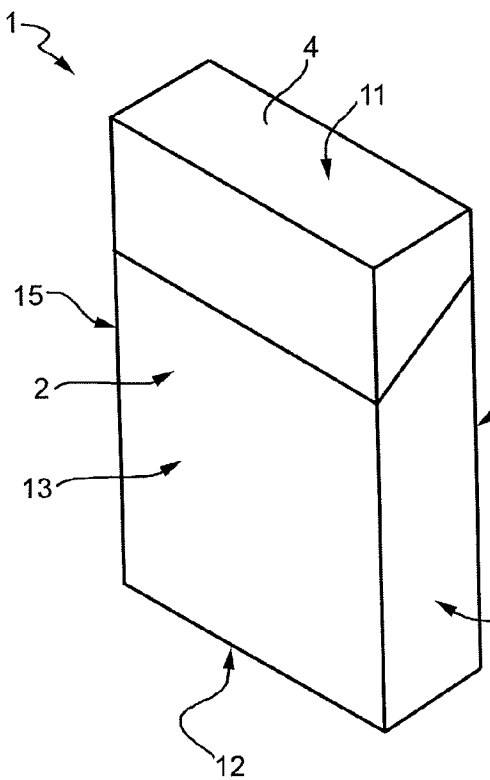
FIG. 1 shows a front view in perspective of a rigid packet of cigarettes in a closed configuration.
Figure 2:
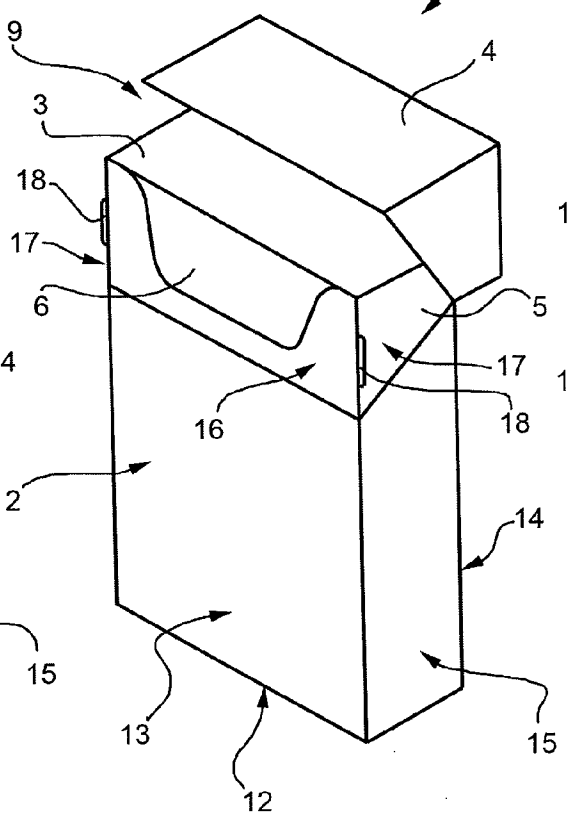
FIG. 2 shows a front view in perspective of the FIG. 1 rigid packet in an open configuration.
Figure 3:
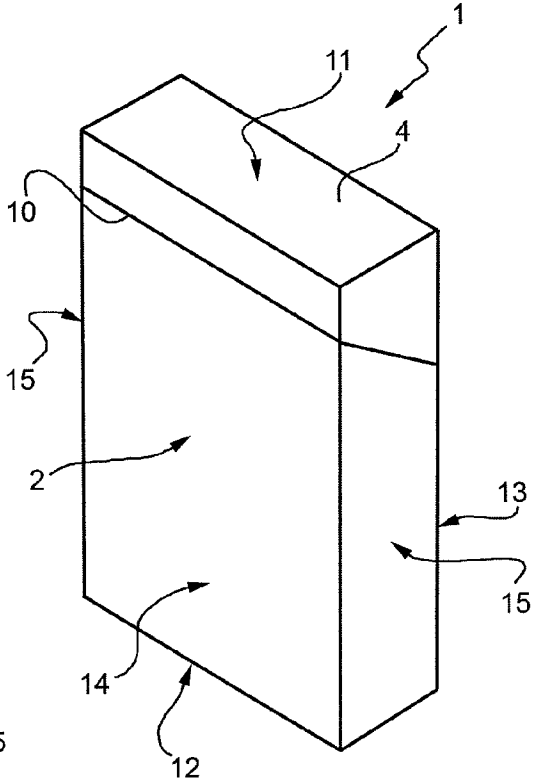
FIG. 3 shows a rear view in perspective of the rigid packet in FIG. 1.

Number 1 in FIGS. 1 to 3 indicates as a whole a rigid packet of cigarettes comprising an outer container 2, an inner package 3, a lid 4, and a collar 5.

Figure 4:
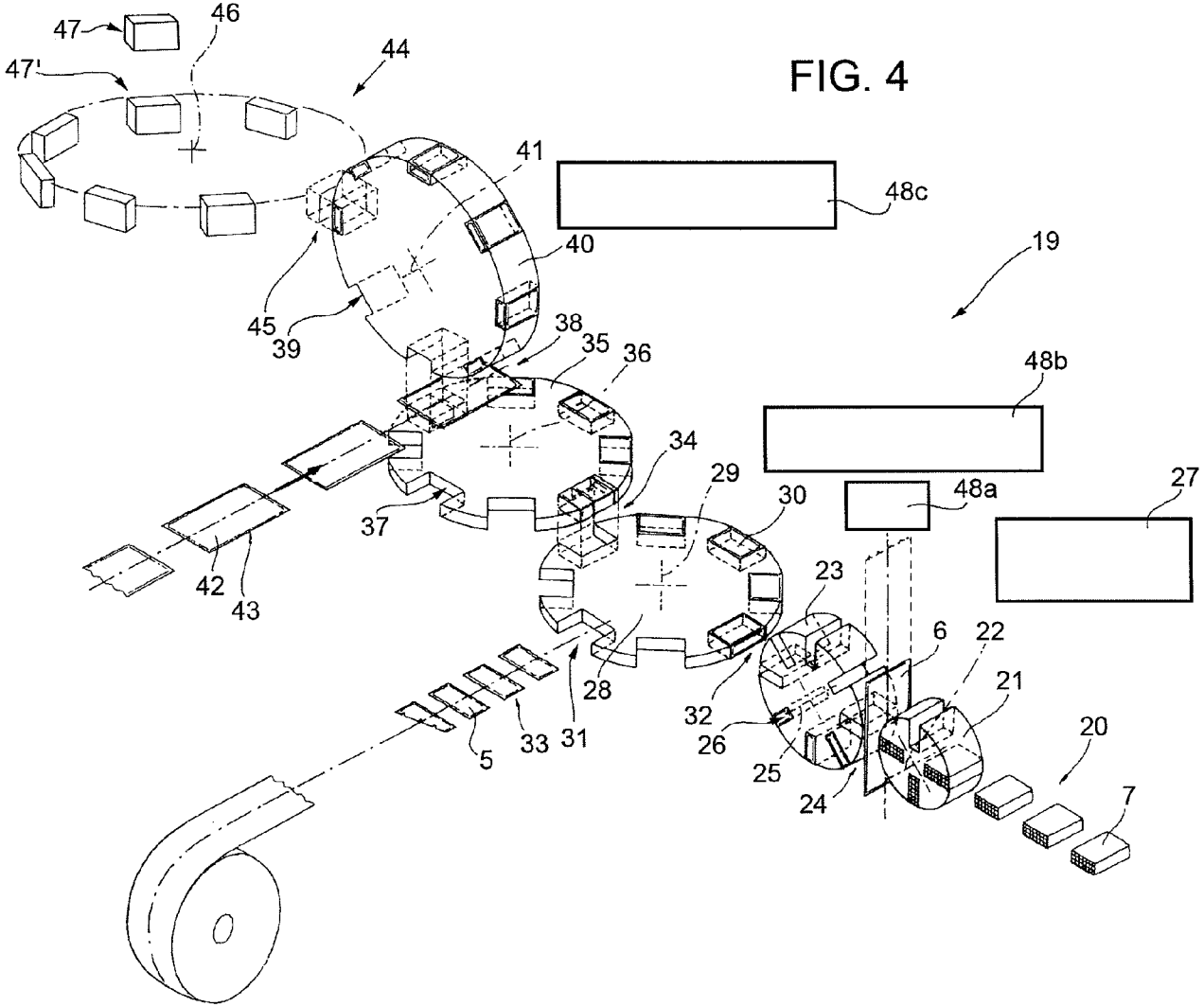
FIG. 4 shows a schematic view in perspective, with parts removed for clarity, of a preferred embodiment of the cigarette packing machine according to the present invention.

Inner package 3 is housed inside container 2, is in the form of a rectangular parallelepiped, and comprises a sheet 6 of packing material wrapped about a group 7 of cigarettes (FIG. 4).

Sheet 6 is made of flexible multilayer material, by which is meant a material comprising at least two superimposed layers of different materials.

Sheet 6 preferably comprises a superimposed opaque layer and transparent layer, or a superimposed opaque layer and reflecting layer.

Figure 7:
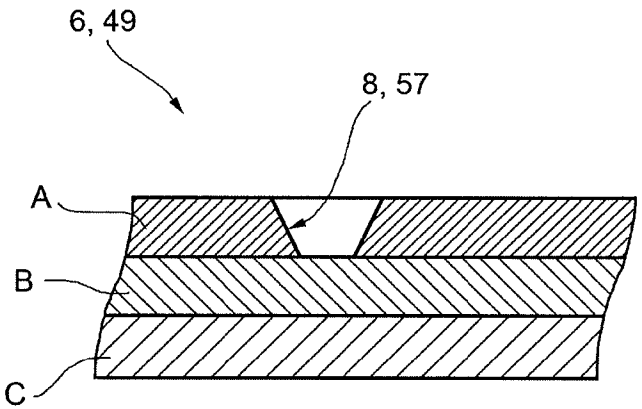

For example, in the FIG. 7 embodiment, sheet 6 comprises an opaque layer A of paper superimposed on a transparent layer B of plastic material—in the example shown, PET.

Figure 8:
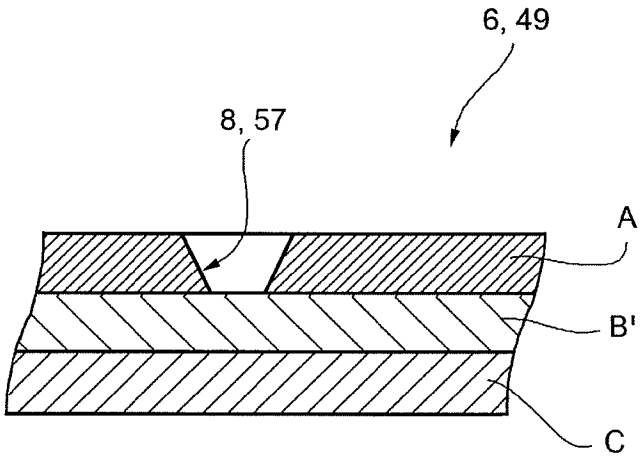
FIGS. 7 and 8 show schematic cross sections of respective alternative embodiments of a detail in FIG. 5.

In the FIG. 8 variation, sheet 6 comprises an opaque layer A of paper superimposed on a reflecting layer B'—in the example shown, foil.

In both the FIGS. 7 and 8 embodiments, sheet 6 comprises an optional inner layer C, preferably made of PE and therefore transparent like transparent layer. B.

Sheet 6 has at least one outer incision 8 (FIGS. 5 to 8) for aesthetic (marking) or functional (opening) purposes. Incision 8 is located at an end portion of a major lateral surface of package 3 exposed when the lid is opened (FIG. 6), and is made in such a way as to remove at least one outer layer, e.g. opaque layer A, and leave at least one of the inner layers of sheet 6 untouched, preferably the layer contacting group 7 of cigarettes in the finished inner package 3.

Container 2 is made of rigid cardboard, is cup-shaped, and has an open top end 9 for access to inner package 3.

Lid 4 is cup-shaped and hinged to container 2 along a hinge 10 (FIG. 3) to rotate, with respect container 2, between an open position (FIG. 2) and a closed position (FIGS. 1, 3) opening and closing top end 9 respectively.

Outer container 2 is in the form of a rectangular parallelepiped when lid 4 is closed.

More specifically, when closed, packet 1 is bounded by a top wall 11 and a bottom wall 12 opposite and parallel to each other; a major front wall 13 and major rear wall 14 opposite and parallel to each other and perpendicular to top and bottom walls 11, 12; and two opposite, parallel minor lateral walls 15 perpendicular to top and bottom walls 11, 12 and front and rear walls 13, 14.

Collar 5 is folded into a U and fixed (normally glued) to the inside of outer container 2, and projects partly outwards of top end 9 to engage a corresponding portion of the inner surface of lid 4 when lid 4 is in the closed position.

Collar 5 is made of rigid cardboard, and comprises a front wall 16 positioned contacting the inner surface of front wall 13; and two lateral walls 17 located on opposite sides of front wall 16 and positioned contacting the inner surfaces of respective lateral walls 15.

In a preferred embodiment, collar 5 has two projections 18, which project laterally to interfere with the lateral walls of lid 4 and so hold lid 4 in the closed position.

Number 19 in FIG. 4 indicates as a whole a cigarette packing machine, which comprises a known group-forming line 20 (only shown partly) for forming groups 7 of cigarettes; and a transfer wheel 21, which rotates in steps about a horizontal axis of rotation 22 to successively receive and transfer groups 7 to a packing wheel 23 at a transfer station 24. Packing wheel is designed to form packages 3 about respective groups 7, is mounted to rotate in steps about a respective axis of rotation 25 parallel to axis of rotation 22, and comprises a number of peripheral pockets 26, each for receiving a group 7 together with a respective sheet 6, which is fed to transfer station 24 by a device 27 for producing sheets 6.

Packing machine 19 also comprises a wheel 28 for applying collar 5, and which rotates in steps about a respective vertical axis of rotation 29 crosswise to axis of rotation 22, and comprises a number of peripheral pockets 30 fed in steps along a given endless path. More specifically, pockets 30 are fed in steps along a circular path extending about axis of rotation and through a feed station 31 for supplying precreased cardboard collars 5. In other words, each pocket 30 is designed to receive a collar 5 at feed station 31, and a package 3 at a transfer station 32.

Collars 5 are supplied to feed station 31 by a feed line 33, and are formed in known manner from a web of cardboard fed off a reel.

At the output of collar application wheel 28—more specifically, at a transfer station 34—collar 5 is folded in known manner into a U about package 3; and the group so formed is expelled from pocket 30 and transferred to a next transfer wheel 35.

Transfer wheel 35 rotates in steps about a respective axis of rotation 36 parallel to axis of rotation 29, is the same design as wheel 28 for applying collar 5, and has a number of peripheral pockets 37. In both pocket 30 on collar application wheel 28, and pocket 37 on transfer wheel 35, each package 3 is positioned flat, i.e. with a minor lateral surface facing outwards, and with its longitudinal axis (always parallel to the cigarettes) positioned crosswise to axes of rotation 29, 36 and tangent to the periphery of relative wheel 28, 35. Transfer wheel 35 and collar application wheel 28 overlap at transfer station 34, and packages 3 are transferred from collar application wheel 28 to transfer wheel 35 by a vertical movement parallel to axes of rotation 29 and 36.

At a transfer station 38, the group defined by package 3 and collar 5 is transferred from a pocket 37 on transfer wheel 35 to a pocket 39 on a packing wheel 40. Packing wheel 40 is mounted to rotate about a respective horizontal axis of rotation 41 parallel to axis of rotation 22, and is designed to receive each package 3 and respective collar 5 together with a respective rigid blank 42 supplied to transfer station 38 by a feed line 43, and to fold each blank 42 about respective package 3 to form a packet 1, in which package 3 is housed inside respective container 2 (FIGS. 1-3) formed by folding blank 42.

Packets 1 are fed successively from packing wheel 40 to a transfer wheel 44 at a transfer station 45. More specifically, each packet 1 arriving at transfer station 45 is positioned on edge on the periphery of packing wheel 40, i.e. with a major lateral surface of package 3 facing radially outwards, and with the longitudinal axis (parallel to the cigarettes) of package 3 parallel to the axis of rotation 41 of packing wheel 40.

Transfer wheel 44 rotates in steps about a respective vertical axis of rotation 46 crosswise to axis of rotation 41 of packing wheel 40, and, at transfer station 45, receives packets 1 successively from packing wheel 40, and transfers packets 1 to a drying zone 47 at a transfer station 47'. Drying zone 47 forms an output of packing machine 19, and communicates with a follow-up cellophaning machine (not shown) for applying an overwrap of transparent plastic material about each packet 1.

A control device 48*a* is located at the periphery of packing wheel 23 to determine the correct position of each sheet 6 wrapped about respective group 7 of cigarettes; a control device 48*b* is located at the periphery of collar application wheel 28 to determine the correct position of each collar 5 with respect to respective incision 8; and a control device 48*c* is located at the periphery of packing wheel 40 to determine the correct position of each package 3 with respect to respective blank 42.

Figure 5:
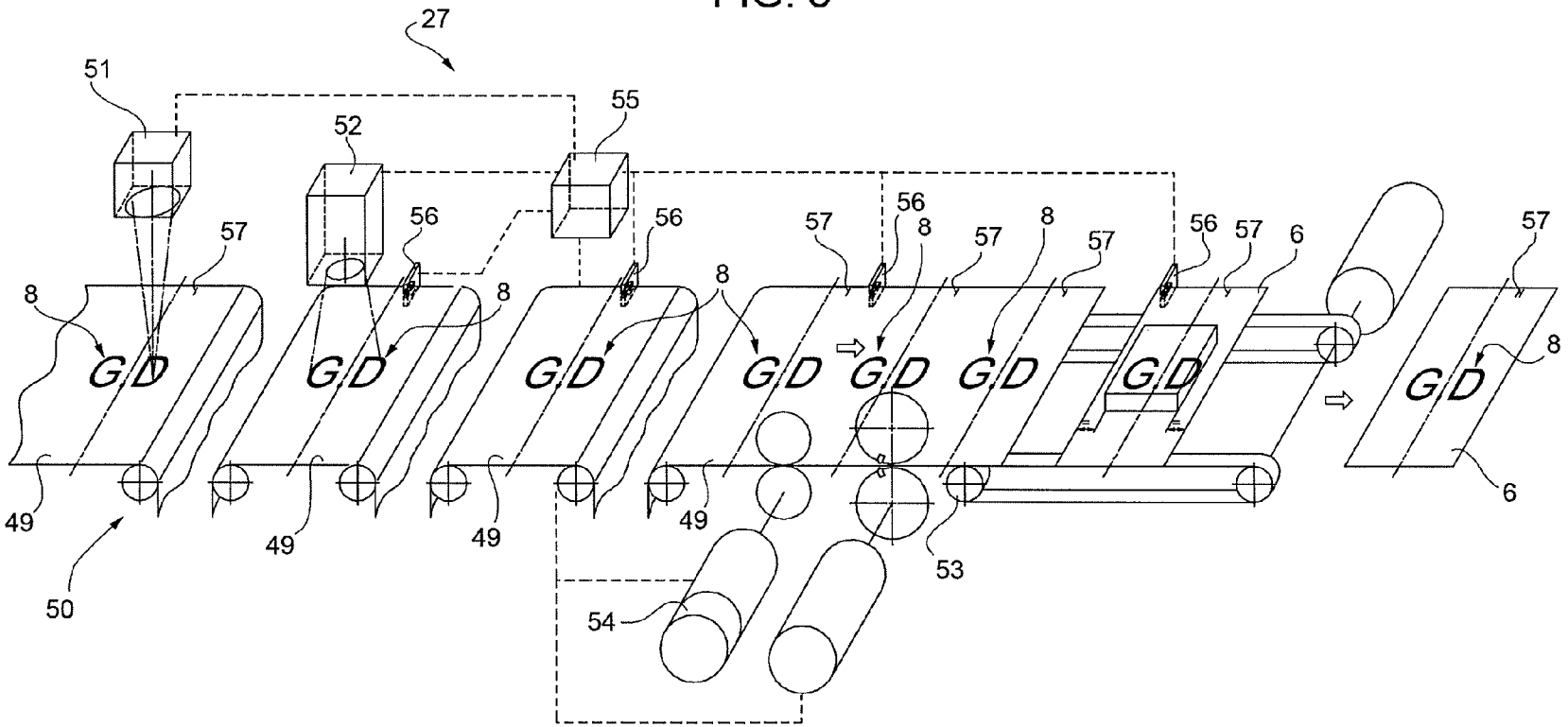
FIG. 5 shows a schematic view in perspective, with parts removed for clarity, of a detail in FIG. 4.

As shown in FIG. 5, device 27 for producing sheets 6 is fed through with a web 49 of multilayer material, obviously of the same structure as sheets 6 to be produced and as described above; and web 49 has no markings printed in ink.

Device 27 may be located on board the machine, as in the example shown, or in a remote location; in which latter case, the sheets 6 produced by device 27 are conveyed to packing machine 19 by known conveyors (not shown).

As shown in FIG. 5, device 27 comprises a conveyor 50 for feeding web 49 in a given travelling direction, and divided into a succession of separate portions, each of which defines, with each adjacent portion, a gap through which web 49 drops to form a build-up loop. In the travelling direction of web 49, device 27 comprises a succession of work stations comprising a material removing station equipped with a device 51 for making physical-chemical alterations to, e.g. removing material from, given portions of web 49, and preferably comprising a laser head; a control station equipped with an optical control device 52; and a cutting station equipped with a cutting device 53.

Device 51 may be either a device for making one type of incision 8, or a programmable device for successively making, in each sheet 6 on web 49, a main incision 8, and a given number of different types of auxiliary incisions (not shown).

Device 27 also comprises a control device 54 for controlling the feed status of web 49 through device 27; and a number of detectors 56 for detecting the presence on web 49 of reference marks 57 also made by device 51. Device 54, detectors 56, and devices 51, 52, 53 are connected to a control unit 55; and device 54 preferably comprises an encoder.

Device 52 checks incisions 8 and any auxiliary incisions are made properly, checks the position of the incisions with respect to reference mark 57, and in particular checks the integrity of at least one layer of web 49 in the incision 8 and reference mark 57 areas of each sheet 6. If the layer of web 49 to be left untouched is reflecting layer B', device 52 is preferably a reflection type.

In actual use, device 51 locally removes one or more outer layers (normally only the outermost opaque layer A) of the multilayer material of web 49, but leaves the innermost layer (normally layer B or B', or layer C if provided) untouched, so as to obtain a succession of continuous sheets 6, from which to form respective packages 3 sealed airtight when closed. In other words, each incision 8 and relative reference mark 57 are both made in the same way, by locally reducing the thickness of web 49 from the outside.

Given the nature described of the component layers of web 49, it follows that each incision 8 and relative reference mark 57 have respective transparent portions visible through opaque layer A in the FIG. 7 variation, or respective reflecting portions visible through opaque layer A in the FIG. 8 variation.

Reference mark 57 associated with each incision 8 is always in the same position with respect to incision 8, but may be of different shapes indicating different operating situations. For example, a reference mark 57 defined (in a manner not shown) by two parallel lines may indicate the relative portion of the web is flawed, and so activate a follow-up reject device (not shown). Similarly, another type of reference mark 57 (not shown) may indicate an end portion of web 49, or the presence of a splice or other similar structural and/or position feature.

Whatever the case, each reference mark 57 is used as a reference to synchronize successive stations on the basis of the feed conditions of web 49 detected by encoder 54, and in particular to time cutting device 53.

Figure 6:
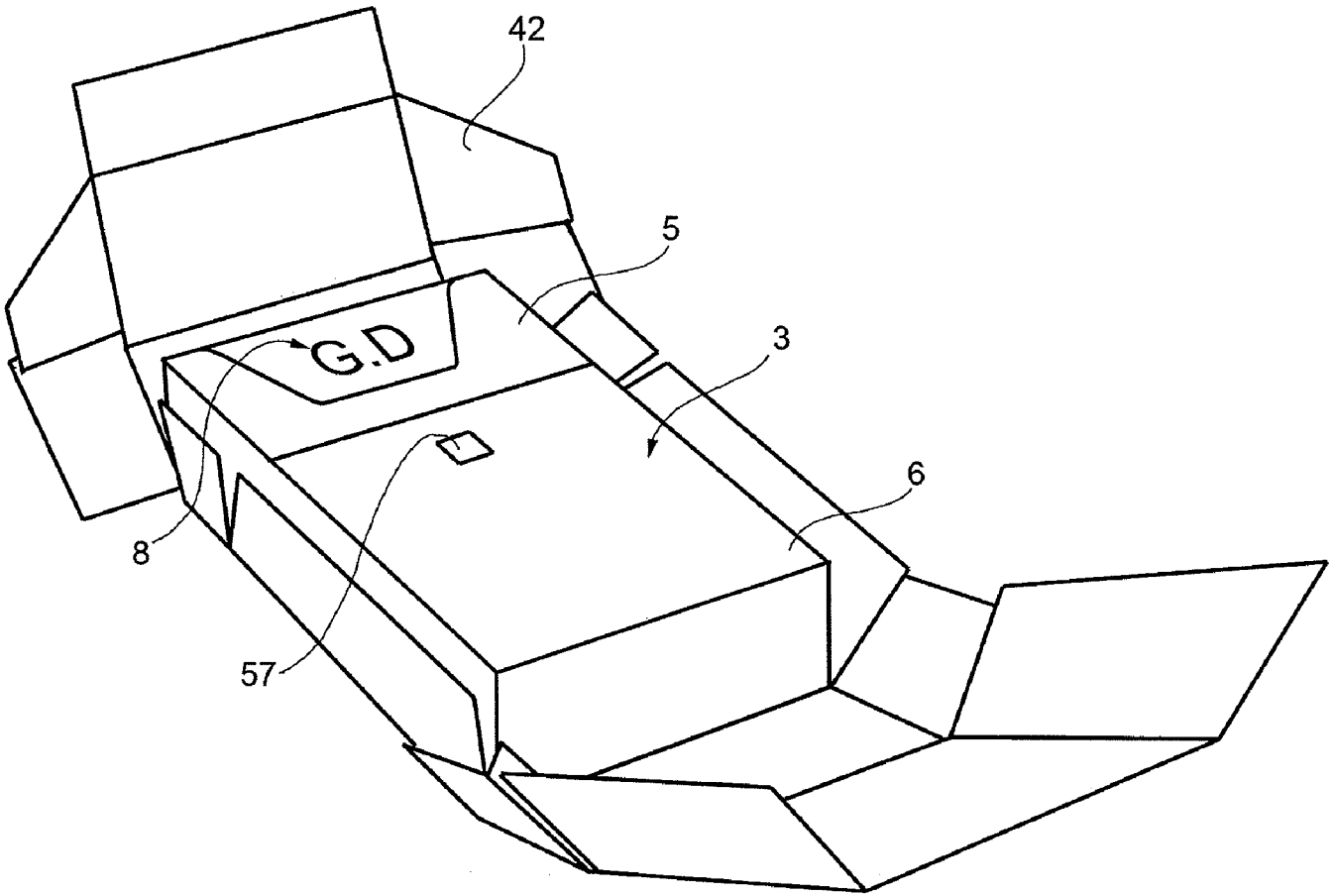
FIG. 6 shows a view in perspective of a variation of the FIG. 1-3 rigid packet during processing.

As regards their location along web 49, reference marks 57 may be located, as in the FIG. 5 example, along a lateral edge of web 49, or, as in the FIG. 6 variation, in such a position as to interact not only with detectors 56 but also with control devices 48*a*, 48*b*, 48*c*, which normally interact, though with some difficulty, with incisions 8. For this reason, as shown in FIG. 6, much more material is removed from layer A at each reference mark 57 than at relative incision 8, so that reference mark 57 is more clearly visible than incision 8; and each reference mark 57 is made so that, once relative sheet 6 is folded about group 7 of cigarettes, it is located on the front surface of package 3, close to relative incision 8.

Reference mark 57 formed as described above simplifies control of sheet 6 at the various stages in the formation of packet of cigarettes 1. More specifically, reference mark 57 allows control device 48*a* to determine correct folding of sheet 6 when forming package 3; control device 48*b* to determine the correct position of package 3 with respect to collar 5; and/or control device 48*c* to determine the position of package 3 inside blank 42.

Figure 9:
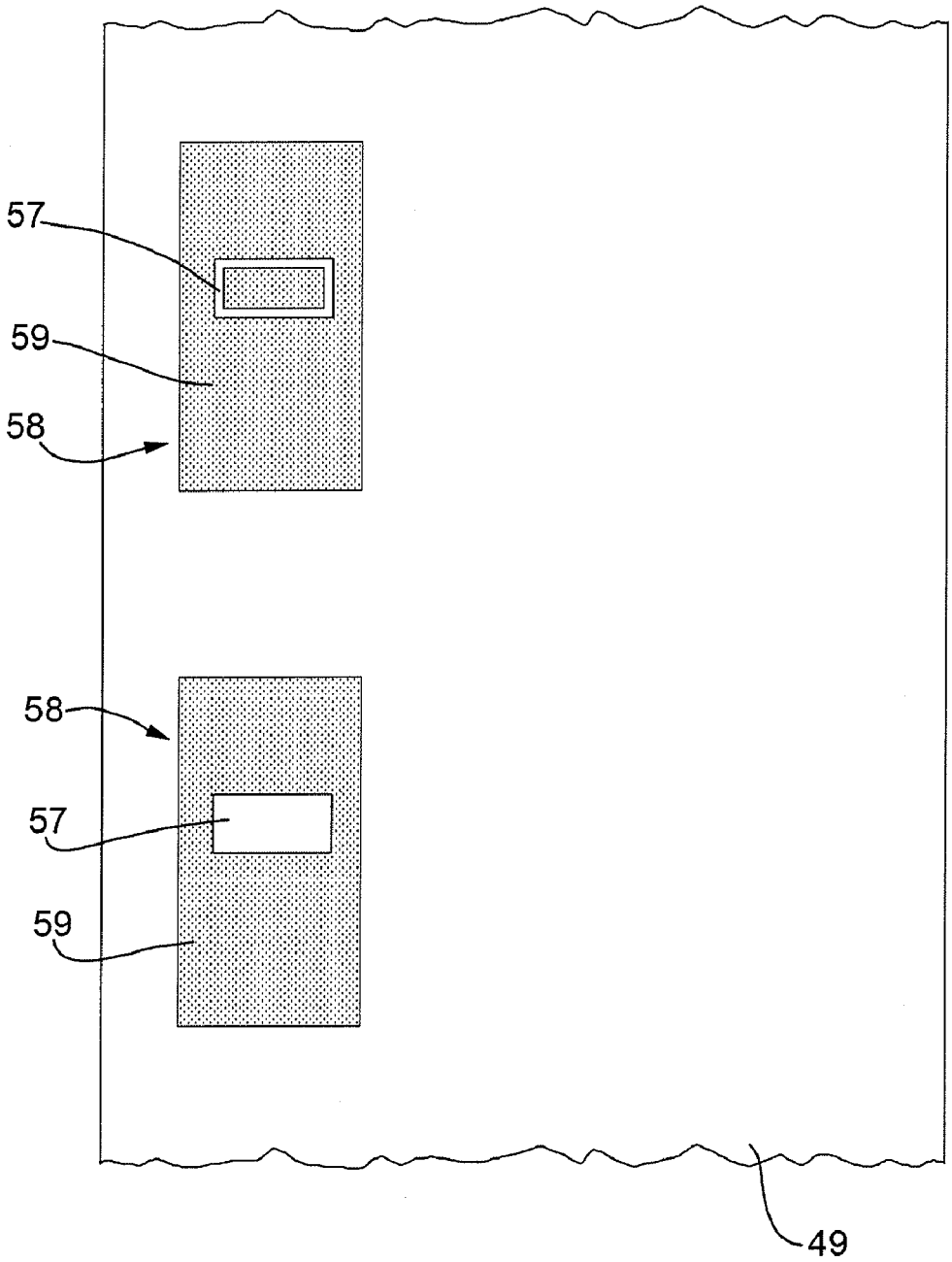
FIG. 9 shows a plan view of a further embodiment of the detail shown in FIGS. 7 and 8.

In the FIG. 9 embodiment, web 49 has a number of portions 58 and comprises a layer of coloured pigment 59 (typically ink) at each portion 58; in particular, portions 58 are equally spaced in the feed direction of web 49. Each reference mark 57 is made in a respective portion 58 by removing part of the coloured pigment 59 at portion 58. In other words, the coloured pigment at each portion 58 constitutes a further surface layer of web 49, which is etched by device 51 to form a reference mark 57.

Figure 10:
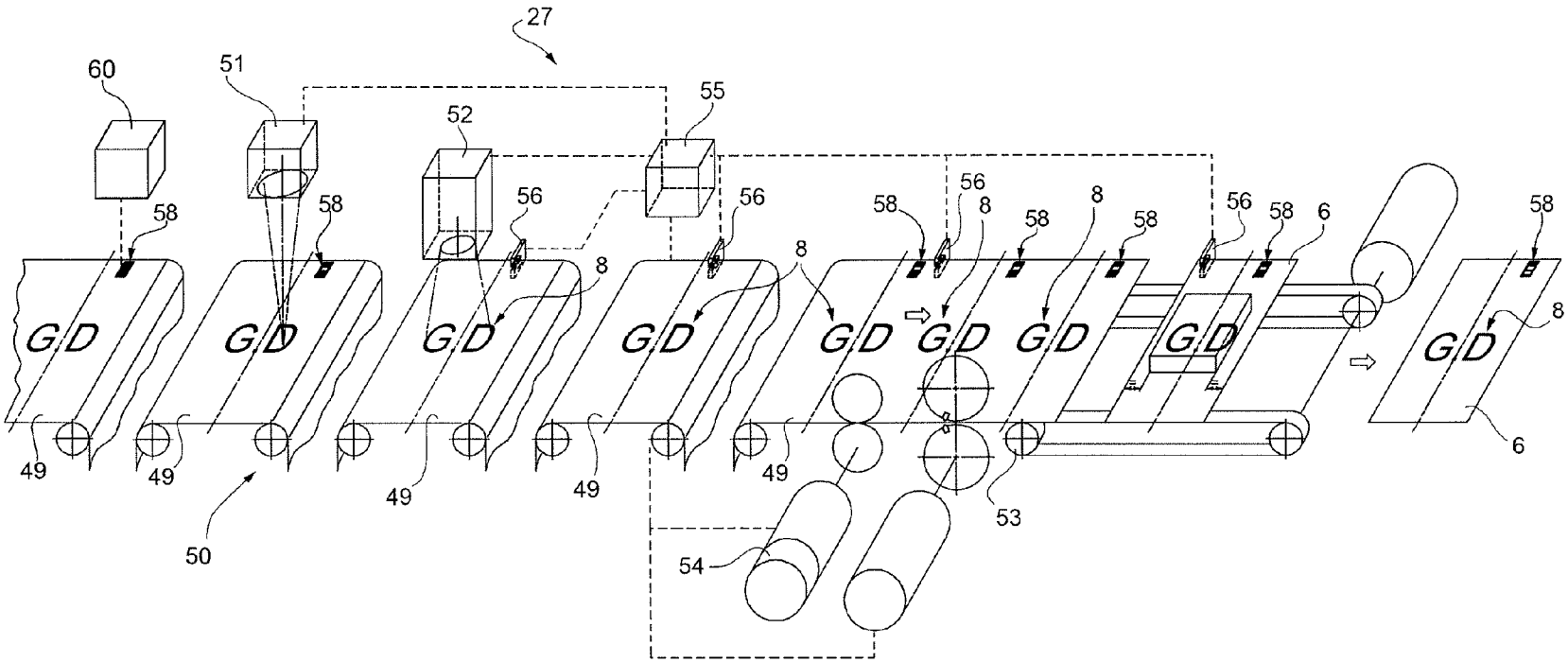
FIG. 10 is similar to FIG. 5 and is a further embodiment of the detail shown in FIG. 4.

In the FIG. 10 embodiment, packing machine 19 comprises a printing device 60 located along device 27, upstream from device 51, to apply a layer of coloured pigment 59 to web 49 to form each portion 58.

Printing device 60 is a known type, preferably an inkjet.

As shown in FIGS. 9 and 10, device 51 is designed to form a number of reference marks 57, each selected from a set of reference marks 57 of different forms and thickness, and to form one or more reference marks 57 in each portion 58 (FIG. 9).

In the FIGS. 9 and 10 embodiment, each reference mark 57 is preferably made by etching only part of the coloured pigment of a portion 58, leaving the other layers of web 49 untouched.

In the FIGS. 9 and 10 embodiment, the laser beam of device 51 is preferably designed so that it is highly effective in removing the coloured pigment 59 of portions 58, while at the same time having little (or no) effect in removing the other layers of web 49.

It is important to note that each portion 58 to which the layer of coloured pigment 59 is applied is located in an area of sheet 6 that is invisible on inner package 3 once sheet 6 is folded, and so has no effect on the external appearance of package 3.

In the FIGS. 9 and 10 embodiment, each reference mark 57 is highly visible (and therefore easily detected) by being highlighted by a marked light and shade contrast (as shown clearly in FIG. 9).

In a variation not shown, to make a main incision 8 and perform one or more different processes and/or operations (not shown) on each sheet 6, device 27 may comprise a succession of devices similar to device 51 or of other appropriate types, and each for performing a respective process and/or operation.

In a variation (not shown) of the present invention, web 49 may comprise an opaque outer layer A, only part of the thickness of which is removed to produce a change in colour with respect to the untouched area, and so form a reference mark that the sensor reads/recognizes as a change in colour by reflection.

In another variation not shown, the colour change may even be achieved by toning, without removing any material. In which case, the same principle also applies to single-layer materials, in particular plastic films, and the reference mark may be coloured by scorching the surface or by toning the material.

Packing machine 19 as described above therefore provides for producing a package 3 for a group 7 of cigarettes using a sheet 6, on which any distinguishing marks are made by removing layers of the material from which sheet 6 is made, as opposed to using printing ink capable of contaminating the cigarettes in group 7.

Another advantage of packing machine 19 lies in the material preferably being removed using a laser head, which permits easy adjustment of packing machine 19 to different brands. That is, the shape, size and position settings of incision 8 and/or reference mark 57 in the laser head can be adjusted easily by simply making software adjustments to control unit 55, with no work required on packing machine 19 itself.

The invention claimed is:

1. A cigarette packing method comprising the steps of:

applying a layer of colored pigment (59) to a portion (58) of a web (49) of packing material;

making, at a work station, at least one reference mark (57) on a web (49) of packing material by removing part of the colored pigment (59) from the portion (58) of the web to which it had been applied;

feeding the web (49) of packing material through a control station arranged down stream of the work station for determining the position of the reference mark (57) on the web (49);

feeding the web (49) through a cutting station, downstream from the control station, to cut from the web (49) a sheet (6) of packing material, the position of which along the web (49) depends on the position of the reference mark (57); and feeding the sheet (6) of packing material to a packing station for folding the sheet (6) of packing material to form a package (3) about a respective group (7) of cigarettes.

2. A method as claimed in claim 1, and comprising the further step of making on the web (49) at least one incision (8), associated with the reference mark (57), by removing packing material from the surface of the web (49).

3. A method as claimed in claim 2, wherein the incision (8) is made at the work station.

4. A method as claimed in claim 2, wherein the reference mark (57) has a much larger surface area than the relative incision (8).

5. A method as claimed in claim 4, and comprising the further step of folding a collar (5) onto the package (3); the reference mark (57) being used to determine the correct position of the collar (5) with respect to the package (3).

6. A method as claimed in claim 5, and comprising the further step of folding a blank (42) about a whole defined by the package (3) and the relative collar (5); the reference mark (57) being used to determine the correct position of the package (3) inside the blank (42).

7. A method as claimed in claim 1, wherein the web (49) is made of multilayer material comprising at least two superimposed layers (A, B; A, B, C; A, B'; A, B', C); removal of packing material from the surface of the web (49) leaving, at least one of said layers (A; B; B'; C) unchanged.

8. A method as claimed in claim 7, wherein the web (49) comprises an opaque outer layer (A), and at least one transparent layer (B; C) adjacent to the opaque outer layer (A); the surface removal of packing material only involving the opaque outer layer (A), and exposing the transparent layer (B; C).

9. A method as claimed in claim 7, wherein the web (49) comprises an opaque outer layer (A), and a reflecting layer (B') adjacent to the opaque outer layer (A); the surface removal of packing material only involving the opaque outer layer (A), and exposing the reflecting layer (B').

10. A method as claimed in claim 7, wherein the web (49) comprises an opaque outer layer (A); the surface removal of packing material only involving part of the thickness of the opaque outer layer (A), and producing a colour change with respect to the unaffected area.

11. A method as claimed in claim 1, wherein part of the colored pigment is removed using laser means (51).

12. A method as claimed in claim 1, wherein the reference mark (57) is selected from a number of different types of reference marks (57); the method comprising at least one follow-up operation, depending on the type of reference mark (57) selected.

13. A method as claimed in claim 12, wherein the reference mark (57) is used to determine the correct position of the sheet (6) of packing material about the relative group (7) of cigarettes.

14. A method as claimed in claim 1, wherein the reference mark (57) is made on a portion of the sheet (6) of packing material defining a front wall of the package (3).

15. A cigarette packing machine (19) comprising:

a printing device (60) to apply a layer of colored pigment (59) to a portion of a web (49) of packing material;

a device (27) for producing a succession of sheets (6) of packing material from the web (49) of packing material; and a packing device for folding each sheet (6) of packing material about a respective group (7) of cigarettes; wherein the device (27) for producing the sheets (6) of packing material comprises a material-removing device (51) for removing part of the colored pigment (59) to make a reference mark (57) on the web (49) and in the portion (58) of colored pigment (59) for each sheet (6) of packing material.

16. A machine as claimed in claim 15, wherein the material-removing device (51) for removing part of the colored pigment (59) comprises laser means.

17. A machine as claimed in claim 15, wherein the material-removing device (51) is designed to leave the continuity of each sheet (6) of packing material uninterrupted.

18. A machine as claimed in claim 15, wherein the web (49) is made of multilayer material comprising at least two superimposed layers (A, B; A, B, C; A, B'; A, B', C); and the material-removing device (51) is designed to remove packing material from the surface of the web, and leave at least one of said layers (A; B; B'; C) unchanged.

19. A machine as claimed in claim 18, wherein the device (27) for producing the sheets (6) of packing material comprises an optical control device (52) located downstream from the material-removing device (51) to determine said layer (A; B; B'; C) is unchanged.

* * * * *